United States Patent [19]

Johns et al.

[11] Patent Number: 4,627,575

[45] Date of Patent: Dec. 9, 1986

[54] UPGRADING SOLID FUELS

[75] Inventors: Reginald B. Johns, North Balwyn; Alan L. Chaffee, Ashfield; David A. Cain, Heidelberg; Alan S. Buchanan, Kallista, all of Australia

[73] Assignees: University of Melbourne; CRA Services Limited, both of Victoria, Australia

[21] Appl. No.: 580,260

[22] Filed: Feb. 15, 1984

[30] Foreign Application Priority Data

Feb. 17, 1983 [AU] Australia ..... PF8078

[51] Int. Cl.[4] ..... B02C 23/18

[52] U.S. Cl. ..... 241/15; 241/17; 241/23

[58] Field of Search ..... 241/17, 21, 23, 15, 241/260.1, 24

[56] References Cited

U.S. PATENT DOCUMENTS

| | | | |
|---|---|---|---|
| 1,576,335 | 3/1926 | Kreisinger | 241/17 |
| 4,132,365 | 1/1979 | Verschuur | 241/21 |
| 4,288,166 | 9/1981 | Nakabayashi | 241/176 X |

FOREIGN PATENT DOCUMENTS

| | | | |
|---|---|---|---|
| 498450 | 5/1974 | Australia . | |
| 848058 | 7/1981 | U.S.S.R. | 241/24 |

*Primary Examiner*—Howard N. Goldberg
*Assistant Examiner*—Timothy V. Eley
*Attorney, Agent, or Firm*—Larson and Taylor

[57] ABSTRACT

A fuel of increased density and calorific value is produced by subjecting brown coal to shearing forces to produce a wet plastic mass which is subsequently compacted and dried.

23 Claims, 2 Drawing Figures

UPGRADING SOLID FUELS

Figure 1:
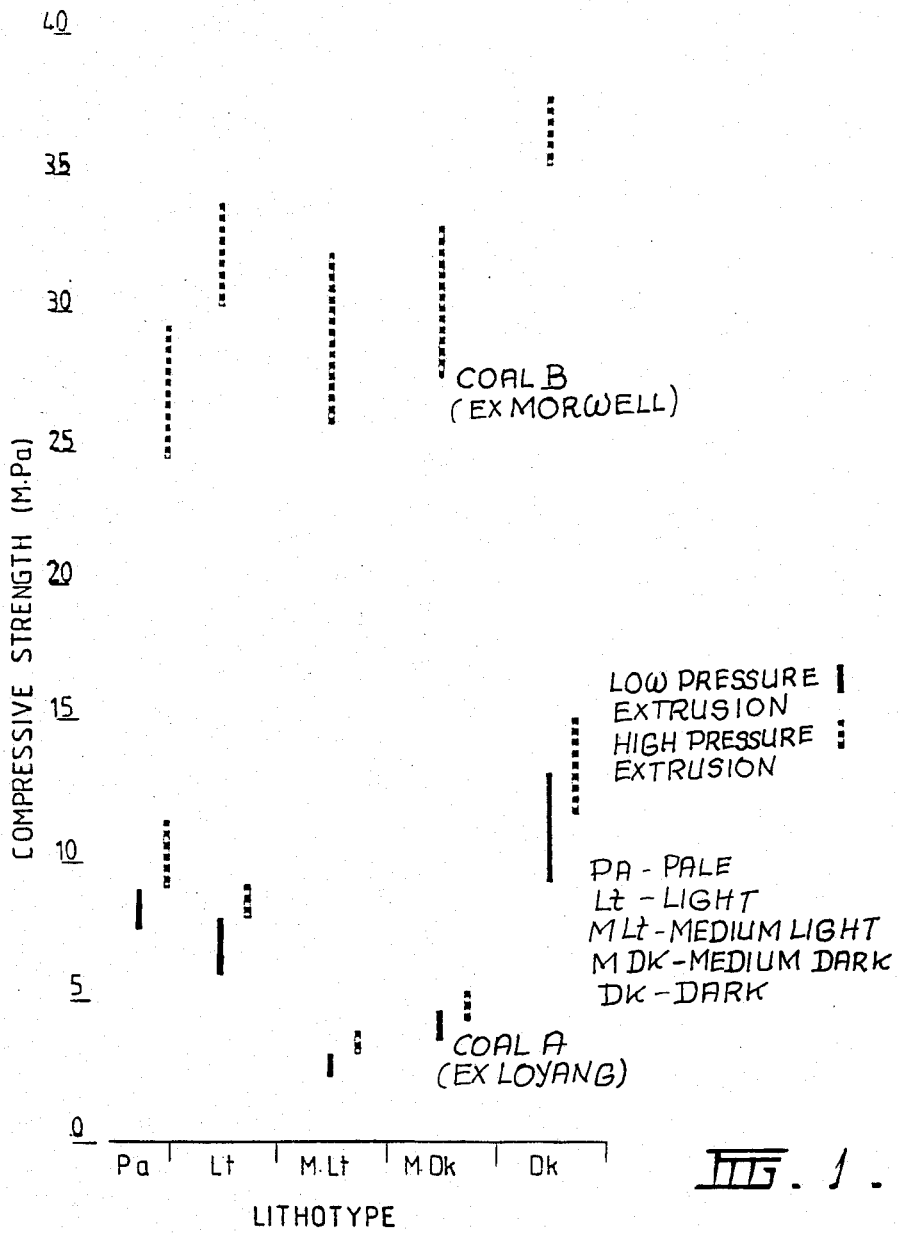

This invention relates to a process for upgrading brown coal.

Brown coals as mined usually have a total moisture content greater than 60%, and in the raw state are soft, friable, low-density materials constituting a very low grade fuel.

This invention provides a process for the conversion of brown coals to hard, relatively dense solid form of fuel of much smaller residual water content and substantially enhanced calorific value per unit weight.

It has important advantages over existing briquetting and solar drying processes for upgrading brown coal. As stated, raw coal frequently has a water content in excess of 60% and its calorific value is accordingly low. By contrast with conventional briquetting no introduced thermal energy is required for removal of this water in our process. By contrast with the solar drying process no additional water is required for the attritioning of 'as mined' coal, the time required for attritioning is reduced from about 16 hours to 3–5 hours and the final drying step takes place over 3–5 days instead of several months (depending on weather conditions). The alternative processes are thus seen to be relatively inefficient and may even be uneconomic.

By comparison with the process involving solar drying the invention (as will be evident from the details set out below) has the additional advantage of reducing the processing times required, with a consequent reduction in size of the operating plant.

Among existing processes briquetting represents a widely used and long established technology to convert brown coal into a hard fuel of higher calorific value. Procedures generally involve drying the raw coal (with an 'as mined' water content generally in excess of 55%) by the application of thermal energy. A water content of 18% is usually sought as an optimum for subsequent briquetting. The dried coal is pressed after cooling to a temperature of 40°–50° C. in an extrusion press or roll briquetting machine.

In this process much thermal energy is required to dry the coal and considerable mechanical work with associated wear is involved in the briquetting operation. as a consequence the briquettes, although they are a high quality fuel, are correspondingly expensive to manufacture.

In recent times solar drying of brown coal to produce a hard product having a water content of the order of 5–10% has been proposed. In this process raw brown coal with 20–25% added water is milled in a ball mill for periods of up to 16 hours. The thixotropic slurry so produced is then exposed in shallow ponds to lose water with solar assistance. During the drying the slurry becomes hard, dark in appearance and resistant to water (that is, the solid is not substantially degraded when contacted with liquid water). The time of drying varies with the weather but may well occupy several months. This process yields a reasonably satisfactory product which may be somewhat variable in quality. It is prolonged both in respect of milling time and exposure of the slurry in solar ponds. The lengthy milling is, of course, energy intensive.

Certain aspects of the invention are illustrated in the accompanying FIGS. 1 and 2, which will be referred to in more detail below.

In a preferred aspect the present invention provides a three-step process involving comminution or attritioning, compaction and drying.

In the attritioning step the coal is subjected principally to shearing, as distinct from grinding, forces. This is accomplished by attritioning in a blending or kneading apparatus or any other machine able to efficiently comminute soft materials by shearing rather than by crushing or abrading.

As mentioned above, the solar drying process employs prolonged grinding in a ball mill. Although we do not wish to be limited by any postulated or theoretical mechanism for the observed beneficial effects of the present invention, we believe it is significant that in the first step of our process the primary fine structure of the coal is comminuted by shearing rather than grinding. Attritioning times may be as short as 1–1½ hours compared with the milling period of up to 16 hours employed in the solar-drying process and energy expenditure is accordingly greatly reduced. The product of this step is a wet, plastic mass. Little or no additional water is required during attritioning, the natural water content of the coal normally being sufficient. Subsequent removal of water is therefore minimised.

In the second step of our process the wet plastic mass of the comminuted coal is compacted, for example, by extrusion into pellets through an extruding or similar compacting device. This has the advantage of giving a product in a very convenient form for efficient drying and for handling. Compaction also appears to force the particles of the slurry into closer proximity with consequent improvement in bonding and coherence.

In the third step of our process the extruded pellets are dried, preferably at or near ambient temperature, with preferably a sufficient air flow to assist in the removal of evolved water vapour. (See FIG. 2 for changes in various properties on drying). In this manner, control of the rate of loss of water and of the temperature ensures that bonding throughout the pellet is uniform and there are no zones of weakness arising from non-uniform shrinkage. Crush strength of the resultant pellets when dry is high and often exceeds that of conventional briquettes. By contrast the solar drying process frequently results in considerable shrinkage cracking and zones of weakness with relatively poor physical performance of the final product.

The experimental information accumulated during the course of our studies of the densification of brown coal leads us to believe that definite chemical bonding is established to link together coal fragments produced by attritioning so that the final material is substantially isotropic in properties and is uniformly hard throughout. Linking together faces of adjacent coal fragments by bridge bonding provides a powerful shrinking mechanism.

As detailed below, we believe that the bridge bonding between coal faces depends on the exposure in freshly cleaved surfaces of highly reactive phenolic species which while attached by chemical bonds to the matrix of the coal polymer structure, have still the capacity to form one or more new chemical bonds to small bridging molecules which span the gaps between coal particles.

It is believed that the surfaces should be freshly formed and in close proximity since reactive species are likely to be lost over time in non-bridging reactions. A high concentration of reactive species in the original coal is clearly advantageous as is a high concentration in the system of small molecules able to form bridging structures.

Whilst the present view of the densification reaction does not require any of the coal solids to dissolve in the aqueous medium developed in the plastic mass, this medium is nevertheless essential in facilitating the formation of the bridge bonding in which a small molecule such as carbon dioxide in solution in the water forms chemical bonds to reactive points on each of the adjacent coal faces. In general it is true that additives, beneficial in the densification process, are solutes in the aqueous phase in which the coal particles are dispersed.

In terms of the above hypothesis good densification bonding requires a high concentration of reactive phenolic species as part of the coal structure and will therefore vary in efficiency with the origin of the coal and with the lithotypes in each coal deposit.

The following observations, amongst others, have led to the development of the hypothesis on the bonding mechanism.

(1) Consistent and major variations in strength of the densified coal have been observed with lithotype variation from one coal deposit and with coals from various deposits indicating constitutional differences critical in the bonding mechanism. (Refer FIG. 1).

(2) The irreversible character of the densification process and the resistance of the product to the action of water indicates that covalent bond formation rather than physical interaction between coal particles is responsible for the transformation. The susceptibility of the densified product to solvent extraction is much reduced and the nature of the extract is changed as are the high temperature pyrolysis volatiles. These observations are also indicative of strong covalent bonding between the coal particles.

(3) The observations point to the participation in the bonding process of molecular species in the coal structure with a natural acid ionisation typically phenols and/or carboxylic acids. The reactivity of covalent bonds in such species is generally dependent on the state of ionisation of the acidic groups which is diminished by increasing acidity of the medium and vice-versa.

(4) Sodium carbonate when added to the aqueous phase during plasticisation greatly increases the strength of the densified product especially for those coals which alone yield relatively weak products (see below).

Crush Strength of Coal Pellets Without and With 0.4% $Na_2CO_3$ Additive

| | Without | With |
|---|---|---|
| | M Pa | |
| Loy Yang coal | 2.8 ± 0.4 | 7.9 ± 0.3 |
| Madingley coal | 24.3 ± 2.8 | 37.7 ± 2.0 |

The effect is not one of pH only since sodium hydroxide addition has small beneficial effect. The carbonate ion (or carbon dioxide in solution) appears to play a vital role in bonding.

(5) Finely divided magnesium carbonate is also very effective as an additive in spite of its comparative insolubility. In this case both magnesium and carbonate ions appear to be involved. Calcium carbonate and/or magnesium carbonate are also effective additives for enhancing pellet strength.

Crush Strength of Madingley Coal Pellets Without and With 5% added Fine Magnesite

| | |
|---|---|
| M Pa | |
| 24.3 ± 2.8 | 37.2 ± 2.0 |

(6) Urea in small concentrations improves bonding strength appreciably and this is particularly useful for those coals which normally densify less effectively. For example Loy Yang medium dark coal displays a crush strength of 5.3±0.5 MPa with no additive and this increases to 8.6±1.7 MPa with 5% added urea—an increase of 62% on the original value. The beneficial effect of organic additives appears to be confined to small carbonyl type molecules; many others tested had adverse effects.

(7) The extent of size reduction determined the strength of the densified product, maximum strength being exhibited only when attritioning is continued beyond the stage of first plasticisation (see below).

Crush Strengths of Pellets made from Narracan Coal

| Time of kneading (hrs) | 3 | 4 | 5 |
|---|---|---|---|
| Crush strength MPa | 19.0 ± 3.5 | 30.0 ± 2.2 | 35.8 ± 1.8 |

Small particles and many freshly cleaved surfaces are thus of major importance. Higher extrusion pressures appear to be significantly beneficial indicating the importance of close contact of the attritioned coal particles for good bonding. (See FIG. 1).

The above observations strongly suggest that reactive molecular species in the freshly exposed coal surfaces are involved in forming bridging covalent bonds between coal particles. Polyhydroxyphenols especially those with meta arrangement of the hydroxyl group (resorcinol, phloroglucinol), have the requisite low temperature reactivity towards electrophilic substitution reactions. The reactivity is pH dependent and increases as the pH rises with conversion of the phenolic hydroxyls to ionic form. The polyhydroxyphenols are able to react with carbon dioxide with this molecule functioning as a simple carbonyl compound in substituting in the aromatic ring. Reaction with formaldehyde occurs in a similar manner.

When coal surfaces containing polyhydroxyphenols attached to the coal molecular skeleton are in close proximity and in an aqueous medium, bridge bonding by the carbonyl compound becomes feasible and offers an effective bonding mechanism to explain the observed characteristics of the process.

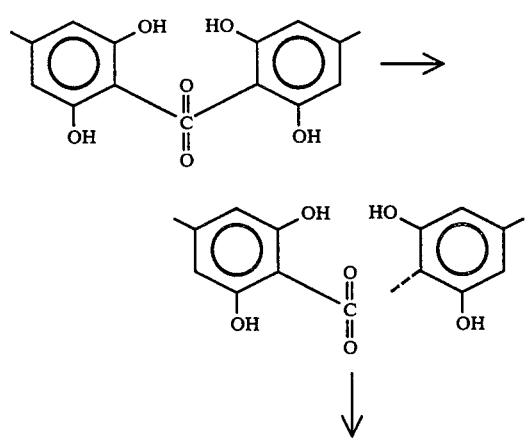

-continued

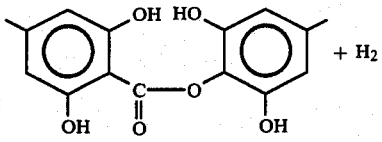

In the presence of divalent cations, e.g. Mg++ further bonding of an electrostatic character becomes possible, for example,

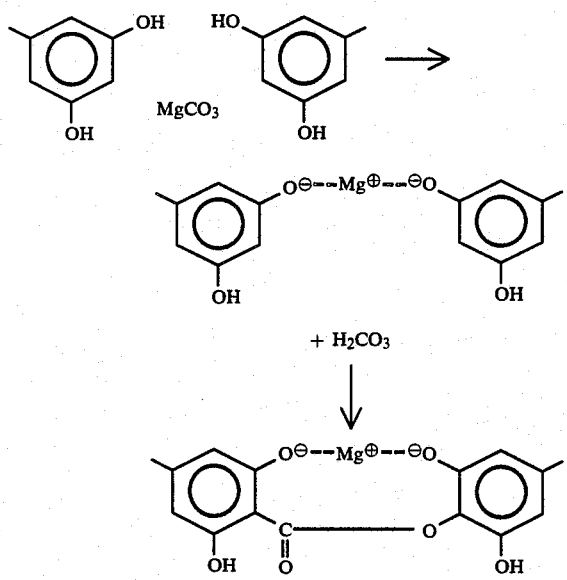

Bridging is now strengthened by the second form of bonding.

The bridge bonding mechanism confers a measure of flexibility on the system in that adjacent coal surfaces may bond without reaching the extremely close proximity required for direct bonding.

It will be clearly understood that the invention is not limited to the foregoing hypothetical discussion, which merely expresses our understanding of the most likely mechanisms at the present time. The benefits of the invention will be obtained by following the practical teachings herein, and persons skilled in the art will appreciate that modification of the underlying theory may occur in the light of subsequent knowledge without detracting in any way from the merits of the present invention.

In a preferred embodiment of the invention, in the first step raw brown coal with an 'as mined' water content of some 60% is subjected to attritioning in a blending or kneading machine/device or other device able to comminute the coal by shearing rather than by using other mechanism(s). In some instances it may be necessary to add up to some 5% of water to facilitate the attritioning process, however with freshly mined coal this is generally not necessary. The essential feature of this stage is that the microstructure of the coal is caused to be subjected to shearing stresses, typically in the case of, e.g., a Sigma blender, such stresses may be produced in a narrow gap between the walls of the blender and the rotating paddles. As mentioned the rupture of the microstructure is believed to expose many new surfaces which contain reactive constituents (such as phenols) able to form new covalent bonds under ambient conditions. The attritioning mechanism will also result in the comminution of the coal to fine particles, able to approach each other more closely thereby permitting inter-particle bonds to develop.

Under the conditions of particle size reduction by shearing, contamination of the newly cleaved surfaces is minimised and the surfaces thus retain maximum activity towards the formation of new bonds. By contrast, size reduction by abrasion against a steel (or other abradable surface) can result in severe contamination of the newly exposed coal faces and a "smearing over" of the disrupted coal structure. Accordingly reactivity of the surfaces will be constantly reduced as abrasion proceeds for longer periods.

Comminution of the microstructure of the raw coal apparently releases water originally contained within the pores and the development of a liquid water phase has been observed after about 1–1½ hours of attritioning. At this time the originally dry (in appearance) and friable coal assumes the form of a wet plastic mass. An appreciable temperature rise (up to 20° C.) is also observed to accompany this change. Most of this may be attributed to exothermic chemical reactions possibly involving atmospheric oxygen, and/or carbon dioxide. The temperature rise results in some loss of water by evaporation and condensation on cool adjacent surfaces.

The first step of the process can be regarded as completed when attritioning has proceeded far enough to yield a finely divided, smooth, wet plastic mass which will enable a densified coal of the required strength to be produced. The second step involves compaction of the wet plastic mass with formation of small pellets. In our experiments a quantity of such mass was extruded through a 10 mm diameter polymer tube attached to a piston-inbarrel device, but any suitable alternative extruding or compacting device may be used. Relatively modest extrusion pressures only are required since it is not the function of this stage to remove liquid water but rather to form the plastic material into a convenient physical, e.g. cylindrical, form and to improve the face-to-face packing and proximity to each other of the particles in the plastic mass.

It should be noted in this connection that higher extrusion pressures (produced in a device with a much narrower orifice) result in development of some bonding of the coal whilst still in the extruder. The resultant extruded mass is considerably harder and of lower water content than normal because part of the water has now become a separate phase. The higher pressures presumably force the coal particles sufficiently close to enable bridge bonding to be established between coal faces in proximity. Such higher pressures may be advantageous in circumstances where relatively high initial strength is required in the extruded material.

It is desirable to extrude the plasticised coal as soon as it is removed from the blending machine otherwise appreciable hardening may occur. If water loss is minimised and the plastic mass kept cool, hardening may be considerably delayed.

The extruded cylinder of coal may be cut into convenient lengths in preparation for the next, controlled, drying stage.

The relatively short time scale of the pellet drying process (in which water is removed from the subdivided mass) compared with solar drying of a large mass of material may be expected to lead to a beneficial reduction in the scale of the plant required.

After drying the product has a uniform vitreous appearance with no obvious shrinkage cracking. Its crush strength is relatively high and may substantially exceed that of pressed brown coal briquettes.

If temperatures during the drying become too high i.e. appreciably above ambient it appears that bonding about suitable nuclei proceeds rapidly and hard domains develop. The space midway between such domains then tends to become deprived of material and as water loss proceeds, shrinkage cracks develop in these regions. Poor crush strength follows.

On the other hand, under conditions of relatively slow hardening and slow water loss, bonding develops uniformly and shrinkage of the whole pellet takes place.

We would expect that the material would be suitable for stockpiling without serious self-heating or dusting characteristics which would further improve its acceptability as a fuel.

Brown coals are often distinguished by having low ash contents and the densified product will accordingly be relatively low in inorganic constituents. The densified product is therefore a useful and valuable starting material for the production by pyrolysis of exceedingly strong char and granular activated carbon.

EXAMPLE

Figure 2:
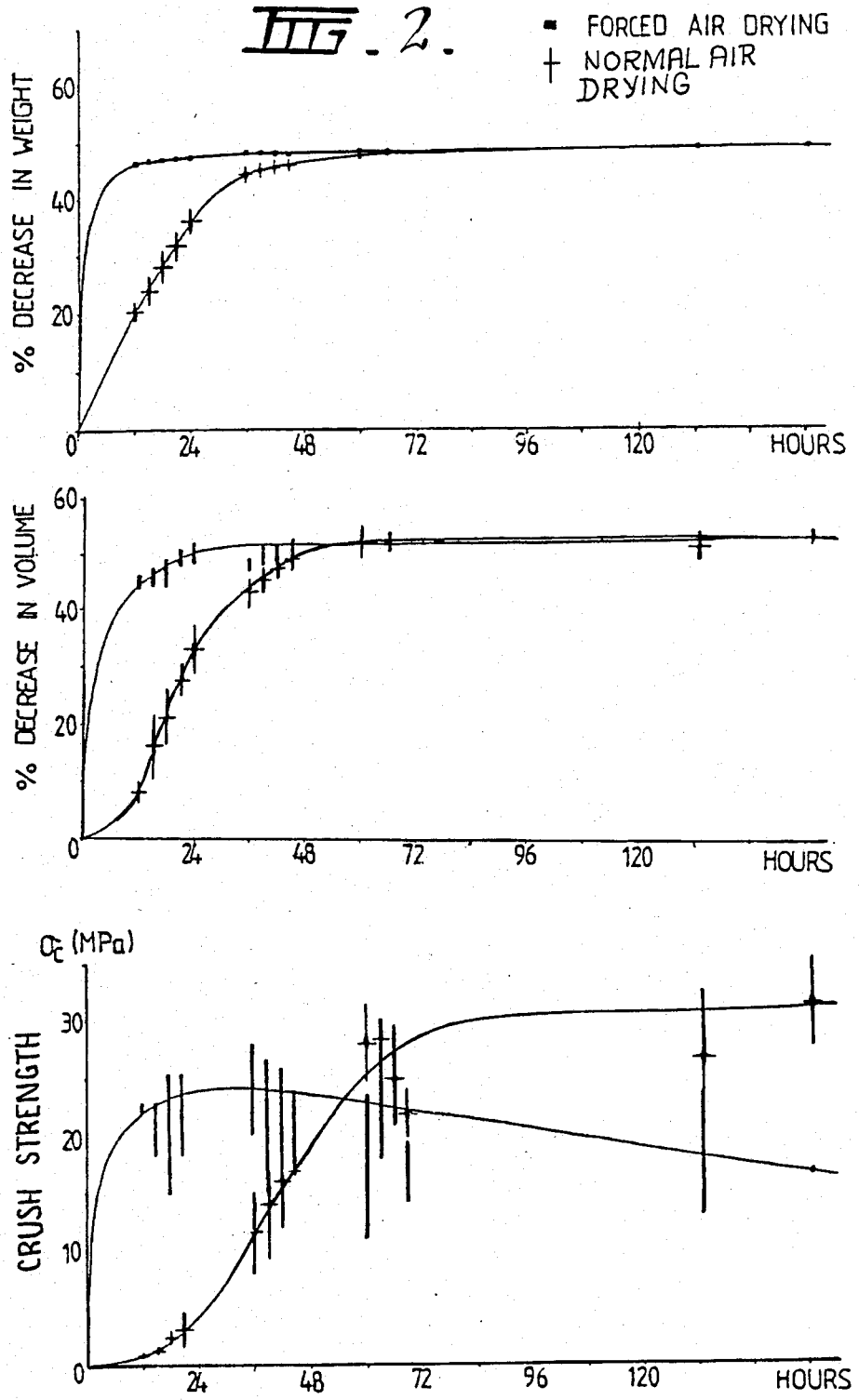

In the attached FIG. 2, three graphs illustrate in a quantitative manner how certain physical mechanical characteristics/properties in the upgraded product are achieved by the process of the invention.

These characteristics/properties are
(i) percentage weight loss (water loss)
(ii) percentage volume decrease
(iii) crush strength Samples of brown coal were obtained from the Narracan deposit in the Latrobe Valley, Victoria, Australia. Experimental quantities of 400 g of this known coal, drawn from a much larger homogenised quantity, were subjected to attrition in a kneader for 5 hours to produce a smooth, wet plastic mass. The relative speeds of the two counter-rotating paddles of the kneader were in the ratio of 3:2 with a clearance of the order of 1 mm between the paddles and the blender box. The blender was actuated by a ½ h.p. motor. The mass produced was extruded and cut into convenient lengths some of which were permitted to stand exposed to the atmosphere at ambient temperature whilst the remaining ones were dried in a stream of air produced by an adjacent fan. The above mentioned characteristics/properties were measured at frequent intervals. The results are shown in FIG. 2.

It should be noted that there is a rapid spontaneous loss of water—in excess of 80% of the contained water in still air—after only 24 hours. The rate of loss is much more rapid when moving air displaces the evolved water vapour.

Crush strength develops somewhat more slowly in still air and reaches a maximum after 5–6 days.

Volume diminishes at about the same rate as crush strength increases.

Drying in moving air considerably enhances the rate of development of strength in the pellets.

The successful application of the drying and densification process to various brown coals (of differing lithotypes) from the Morwell, Loy Yang and Narracan deposits in the Latrobe Valley, Victoria, and also from the Madingley deposit at Bacchus Marsh in Victoria has been established.

Further useful applications of the novel product of the invention will be apparent to persons skilled in the art.

We claim:

1. Process for treatment of brown coal which comprises subjecting the said brown coal to shearing forces to produce a wet plastic mass said mass being capable of conversion by subsequent compaction and drying into a fuel of increased density and enhanced calorific value.

2. Process according to claim 1 in which the brown coal is subjected to said shearing forces without added water.

3. A process according to claim 2 wherein said coal is subjected to said shearing forces in a kneader.

4. A process according to claim 2 wherein said coal is subjected to said shearing forces in a blender.

5. Process according to claim 1 in which the brown coal is subjected to said shearing forces with less than 5% of added water.

6. A process according to claim 5 wherein said coal is subjected to said shearing forces in a kneader.

7. A process according according to claim 5 wherein said coal is subjected to said shearing forces in a blender.

8. Process for upgrading brown coal which comprises subjecting the brown coal to shearing forces to produce a wet plastic mass, compacting the said plastic mass to produce a compacted mass, and drying said compacted mass to produce a dry product of increased density and enhanced calorific value.

9. Process according to claim 8 in which the brown coal is subjected to said shearing forces without added water.

10. A process according to claim 9 wherein said coal is subjected to said shearing forces in a kneader.

11. A process according to claim 9 wherein said coal is subjected to said shearing forces in a blender.

12. Process according to claim 8 in which the brown coal is subjected to said shearing forces with less than 5% of added water.

13. A process according to claim 12 wherein said coal is subjected to said shearing forces in a kneader.

14. A process according to claim 12 wherein said coal is subjected to said shearing forces in a blender.

15. Process according to claim 8 in which said compacting is effected by extruding the plastic mass.

16. Process according to claim 8 in which said drying is effected at ambient temperature.

17. Process for upgrading raw brown coal comprising the following steps:

(a) subjecting the brown coal to shearing forces to produce a wet plastic mass;
(b) compacting the said plastic mass to produce a compacted mass,
(c) subdividing said compacted mass to facilitate subsequent drying; and
(d) drying the subdivided product of step (c) at ambient temperature to produce a dry product of increased density and enhanced calorific value relative to the raw brown coal.

18. Process according to claim 5, in which step (a) is effected with less than 5% of added water; step (b) is effected by extruding the plastic mass; step (c) is effected by cutting the extrudate into convenient lengths;

and step (d) is effected with slow air movement over the product of step (c).

19. A process according to claim 18 in which step (a) is effected without added water.

20. A process according to claim 19 wherein said coal is subjected to said shearing forces in a kneader.

21. A process according to claim 19 wherein said coal is subjected to said shearing forces in a blender.

22. A process according to claim 18 wherein said coal is subjected to said shearing forces in a kneader.

23. A process according to claim 18 wherein said coal is subjected to said shearing forces in a blender.

* * * * *